US005271533A

United States Patent [19]

Joulia

[11] Patent Number: 5,271,533

[45] Date of Patent: Dec. 21, 1993

[54] CONTAINER PROVIDED WITH A SPRING CLOSURE DEVICE

[75] Inventor: Gérard Joulia, Paris, France

[73] Assignee: L'Oreal, Paris, France

[21] Appl. No.: 881,505

[22] Filed: May 11, 1992

[30] Foreign Application Priority Data

May 21, 1991 [FR] France ..... 91 06097

[51] Int. Cl.[5] ..... B65D 83/00

[52] U.S. Cl. ..... 222/402.13; 222/494; 222/149

[58] Field of Search ..... 222/212, 213, 149, 150, 222/494, 498, 496, 490, 402.13, 402.1

[56] References Cited

U.S. PATENT DOCUMENTS

| | | | |
|---|---|---|---|
| 2,667,992 | 2/1954 | Hammond et al. | 222/490 |
| 4,227,650 | 10/1980 | McKinney | 222/494 |
| 4,739,906 | 4/1988 | LoTurco | 222/212 |

FOREIGN PATENT DOCUMENTS

| | | |
|---|---|---|
| 0296004 | 12/1988 | European Pat. Off. . |
| 0388947 | 9/1990 | European Pat. Off. . |
| 1092480 | 4/1955 | France . |
| 212277 | 5/1924 | United Kingdom . |
| 9011236 | 4/1990 | World Int. Prop. O. . |

*Primary Examiner*—H. Grant Skaggs
*Attorney, Agent, or Firm*—Cushman, Darby & Cushman

[57] ABSTRACT

The container (1) is provided with a spring closure device, the container being provided with an outlet channel (12) for the product ending in an orifice (14), the orifice being closed with the aid of a membrane (2) of flexible material which is deformed under the pressure of the product to be dispensed. The membrane (2) is provided both with a pin (22) capable of covering the orifice (14) and with openings (23) which, if there is no deformation of the membrane (2), remain closed by virtue of the elastic properties of the membrane (2).

3 Claims, 3 Drawing Sheets

CONTAINER PROVIDED WITH A SPRING CLOSURE DEVICE

BACKGROUND OF THE INVENTION

1. Field of the Invention

This invention relates to a container provided with a spring closure device, the said container having an outlet channel for the product to be dispensed, the orifice of the said channel being closed by a membrane, of which at least one flexible part is deformed under the pressure of the product dispensed and clears openings hitherto closed by virtue of the elastic properties of the membrane.

2. Description of the Prior Art

It is known from FR-A-1 092 480 to protect the product contained in a container after the first use without the user having to effect any special operation. To this end, the neck of a container that can be deformed by pressure by the user on the walls thereof (e.g. a tube) is fitted with a cover having at least one flexible part that can be deformed under the pressure of the product dispensed. The cover can be provided with slots or holes which open upon the deformation thereof, or a flexible part of the cover can form a valve which cooperates with a rigid seat. However, the air tightness of this type of closure is not always satisfactory and, in the case of prolonged storage, there is often a secondary air intake which may alter the product contained in the container. In order to improve tightness, it has been proposed to cover the cover with a cap. However, in this case, the user must remember to replace the cap each time the container is used, thereby removing the advantage of the use of a device having a spring closure device.

The aim of this invention is to provide a spring closure device by means of which it is possible to obtain good tightness without having to, cover it with a cap each time it is used.

SUMMARY OF THE INVENTION

The problem of this invention is solved by using a membrane having both a closure pin which closes the outlet orifice of the channel and at least one opening which is closed when the membrane is in the closed position.

This invention consequently relates to a container provided with a spring closure device, the said container having an outlet channel for the product to be dispensed, the orifice of which is closed by a membrane of flexible material, at least part of which is deformed under the pressure of the product when it is dispensed and clears at least one passage hitherto closed by virtue of the elastic properties of the material of the membrane, characterized in that the face of the membrane directed towards the container is provided with a closure pin for the orifice of the outlet channel and that the membrane is provided with at least one opening capable of ensuring delivery of the product.

The operation of the spring closure device according to the invention is ensured in the following manner. Under the pressure of the product dispensed, the closure pin is released from the orifice of the outlet channel and simultaneously the membrane inflates. When the deformation of the membrane is sufficient, the opening (or openings) hitherto closed by virtue of the elasticity of the membrane open(s) to clear a passage through which the product to be dispensed can flow. When the pressure exerted by the product ceases, the flexible membrane returns to its rest position, the opening (or openings) close(s) again and the closure pin once again stops the orifice of the outlet channel. It will be seen that, according to the invention, the flexible membrane alone ensures a double closure system by means of which it is possible to obtain satisfactory tightness.

The spring closure device according to the invention can be fitted equally to a container having a deformable wall and to a pressurized container containing a propellant and to which a distributor head having the outlet channel and its orifice is fixed.

The membrane may be made of any elastically deformable material, such as natural or synthetic rubber, silicone rubber or of ethylene vinyl acetate (EVA).

According to a preferred embodiment of the spring device, the membrane is symmetrical with respect to the axis of pressure of the product to be dispensed, the closure pin being situated on this axis and the opening (or openings) being eccentric with respect to this axis.

The outlet orifice is preferably formed in a component of rigid material which serves as a seat for the flexible membrane, the membrane covering the said component in its entirety and being fixed to the periphery of the said component.

The pin is preferably conical.

According to a first embodiment, the openings may be formed by microholes, e.g. pierced with the aid of a needle, or slots having dimensions such that their edges can move apart upon the deformation of the flexible membrane and return to virtually sealed contact by means of elasticity when the membrane is in the closed position. According to another embodiment, the opening (or openings) is (are) formed by holes or slots, the edges of which cooperate with the rigid surface of an element projecting from the seat in which the orifice of the outlet channel is formed.

BRIEF DESCRIPTION OF THE INVENTION

The invention will be more readily understood from the following description of several embodiments of the device according to the invention, given by way of non-limiting examples and illustrated in the accompanying drawings, in which.

Figure 1:
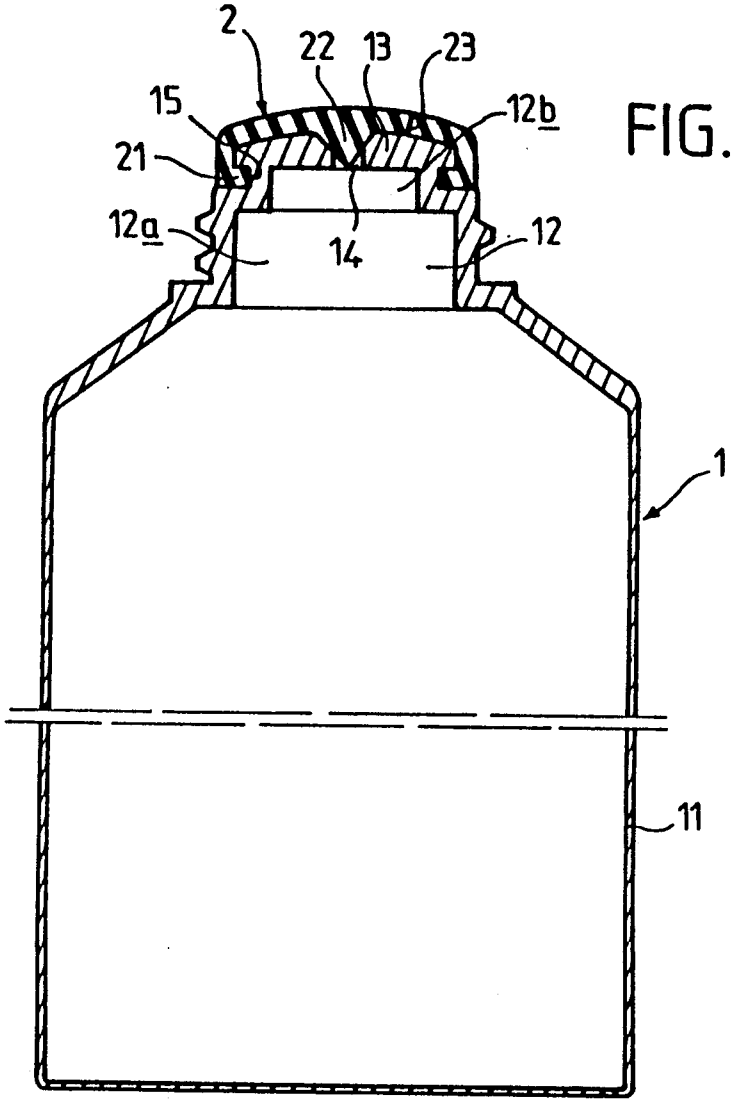

The closure device shown in FIG. 1 is fitted to a container 1 of flexible material that can be deformed by the user by manual pressure on its lateral wall 11. The container contains the product to be dispensed. It is provided with a cylindrical neck 12 consisting of two parts having different diameters 12*a* and 12*b*, the part having the smaller diameter 12*b* being closer to the end of the neck 12. The part 12*b* of the neck 12 is closed by a slightly curved component of rigid plastic 13 disposed perpendicularly to the axis of the neck. An orifice 14 has been formed in this component 13. The orifice 14 is the orifice of the outlet channel for the product, which is dispensed via the neck 12 of the container 1. According to the embodiment shown in FIGS. 1 to 3, the orifice 14 is in the shape of a funnel, the conical part of which opens towards the exterior.

The component 13 disposed on the neck 12 is completely covered by a membrane 2 of flexible material. This membrane 2 is fixed to the periphery of the component 13 by means of a flange 21 fitting into a groove 15 formed on the outer wall of the part 12*b* of the neck. A conical pin 22 having the same axis as the neck is disposed on the face of the membrane 2 opposite the component 13. The pin 22 has at its base a diameter equal, except for the necessary clearance, to that of the larger base of the truncated part of the orifice 14 formed in the component 13. A series of holes 23 are spaced at regular intervals over a circle, the center of which is situated on the axis of the neck 12 and the diameter of which is smaller than that of the part 12*b* of the neck. These holes have been pierced with the aid of a needle.

The operation of the closure device is as follows. In the rest position (see FIG. 1), the pin 22 rests in a sealed manner in the orifice 14. The inner wall of the membrane 2 rests completely on the upper face of the component 13, which consequently serves as a seat for the said membrane. The holes 23 are kept closed by virtue of the elasticity of the membrane 2. When the user wishes to dispense the product contained in the container 1, he presses manually on the lateral wall 11 of the container 1 so as to deform it and to reduce its inner volume. The product moves into the neck 12 and exerts pressure on the pin 22 which, by virtue of the elasticity of the membrane 2, clears the orifice 14. Under the pressure of the product to be dispensed, the membrane 2 continues to be deformed and inflates, creating a space E between the membrane 2 and the component 13 forming the seat (see FIG. 2), said space E being filled with product. Finally, the deformation of the membrane 2 results in opening of the holes 23 (see Figure 3). Delivery of the product then commences.

When the user ceases to press on the walls 11 of the container 1, the walls resume their initial form, there is slight aspiration and the product ceases to exert pressure on the membrane 2 which returns to its initial closed position by means of elasticity. The holes 23 are closed immediately and there is no return air intake. The product is therefore not in contact with air during storage. The pin 22 closes the orifice 14 again and the membrane 2 once again comes into contact with the component 13. The container is closed again and can be stored with no risk of air altering the product it contains.

Figure 2:
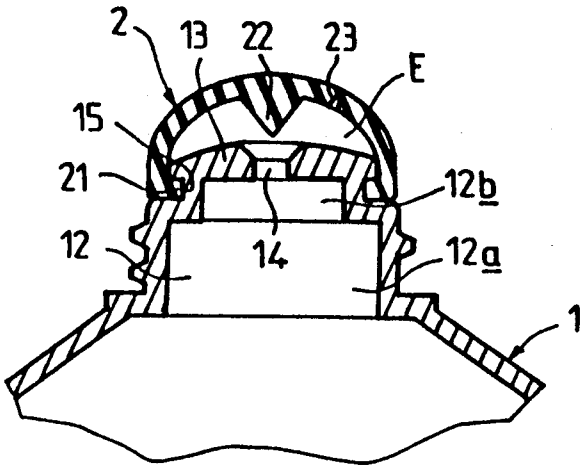
FIGS. 1 to 3 are longitudinal sections of a first embodiment of a device according to the invention at various stages of the opening process.
Figure 3:
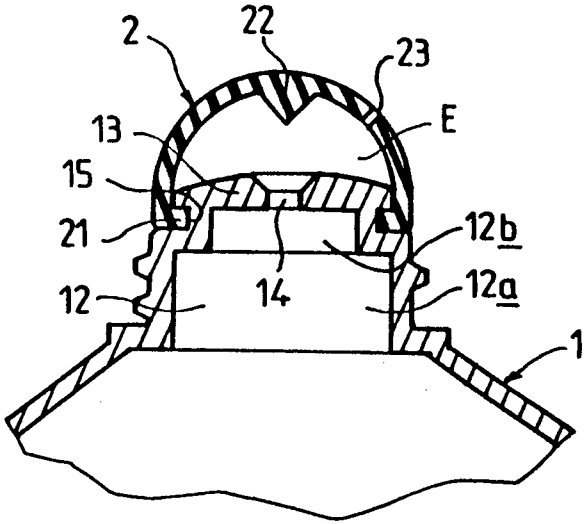
Figure 4:
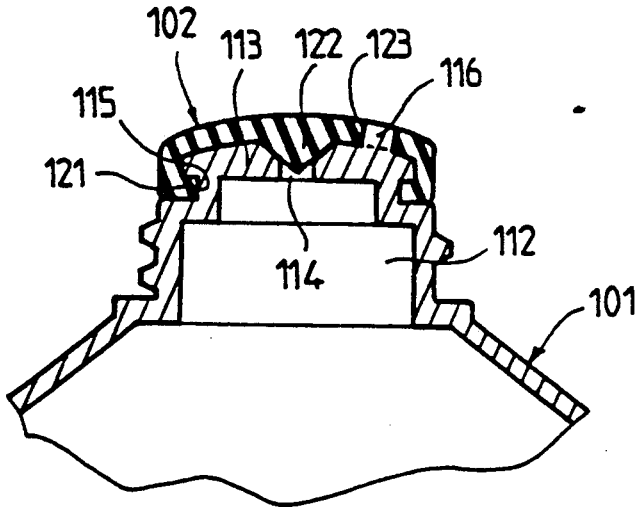
FIGS. 4 to 6 are longitudinal sections of a second embodiment of a device according to the invention at various stages of the opening process.
Figure 5:
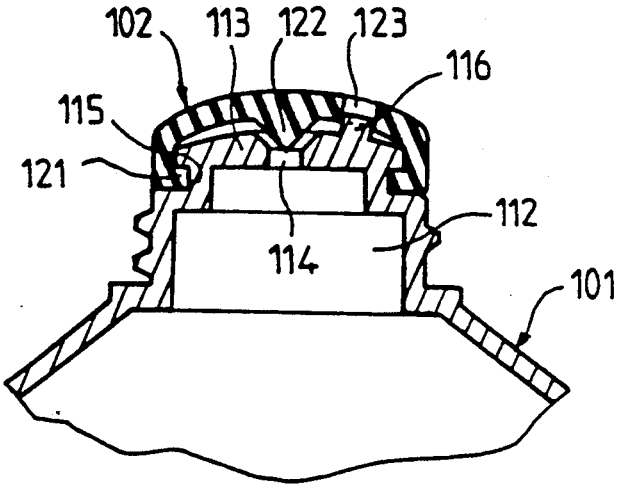
Figure 6:
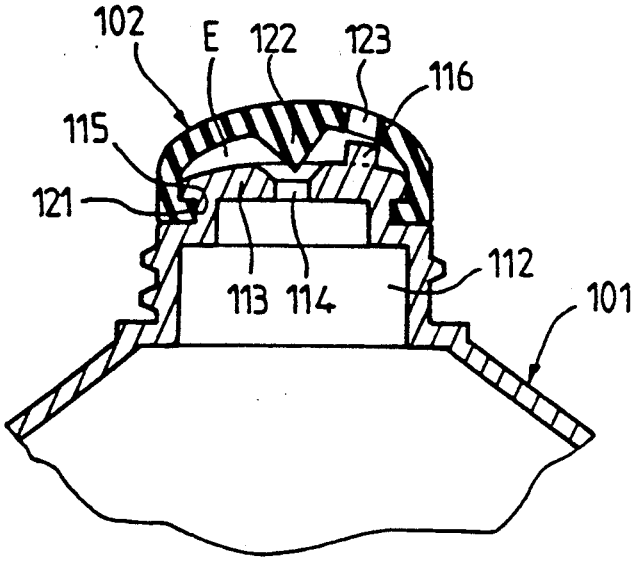

In the embodiment shown in FIGS. 4 to 6, the container 101 is identical to the one shown in FIGS. 1 to 3. In the following description and in FIGS. 4 to 6, the components identical to or having the same function as those described hereinabove with reference to Figures to 3 are designated by the same reference numerals increased by 100. The neck 112 is closed by a component 113 in which the orifice 114 of the outlet channel for the product dispensed via the neck 112 is formed. The component 113 is provided with a cylindrical projection 116. The membrane 102 is fixed to the neck by means of a snap engagement system (flange 121 - groove 115). It is provided on its inner face with a pin 122. An opening 123 is formed in the membrane, this opening being disposed in such a manner and having a diameter such that the projection 116 can penetrate into the opening 123 and stop it.

The operation of the closure device is analogous to that described in the case of the device of FIGS. 1 to 3. The pressure of the product deforms the membrane 102 so that the pin 122 comes out of the orifice 114 (see FIG. 5), then a space E is formed between the membrane 102 and the component 113, and finally (see FIG. 6) the projection 116 is released from the opening 123. When the pressure of the product ceases, the membrane 102 resumes it position on the component 113, the projection 116 closing the opening 123 and the pin 122 closing the orifice 114.

In the embodiments shown in FIGS. 7 to 10, the product to be dispensed is contained in a pressurized container provided with a distributor head.

Figure 7:
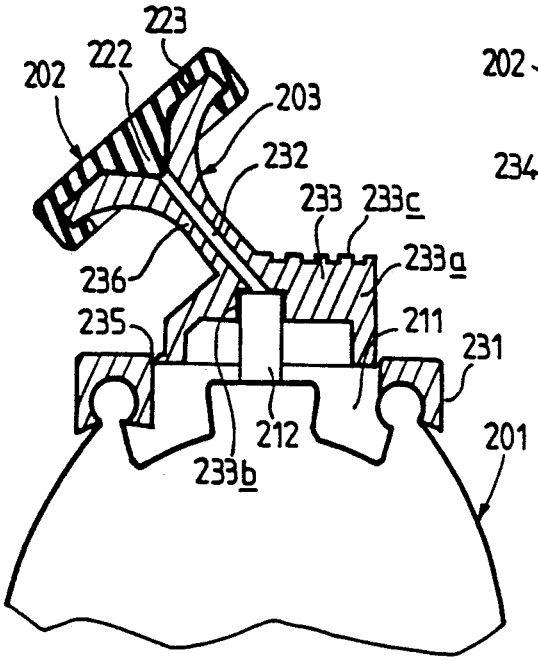
FIGS. 7 and 8 are longitudinal sections of a third embodiment of a device according to the invention at various stages of the opening process.

As can be seen in FIG. 7, the container 201 is closed by a valve cup 211 fixed by a crimping flange to the upper edge of the container 201, a valve 212 being crimped to the center of the cup 211. The valve stem projects out from the cup. A distributor head 203 is fixed by snapping to the crimping flange by means of a fixed skirt 231. A movable part 233 forming a push-button is connected by means of a hinge 235 to the skirt 231. The movable part 233 has a plate 233*a*, the median plane of which is, in its entirety, perpendicular to the axis of the valve stem 212. A bore 233*b* into which the valve stem 212 can be inserted is formed on the lower face of this plate. The upper face of the said plate has a flat part 233*c* on which the user can press in order to depress the push-button. A trumpet-like element 236 which is inclined with respect to the axis of the valve stem 212 is disposed on the upper face of the plate 233. A channel 232 is formed in this element 236 and opens towards the exterior via a truncated orifice 234 widening towards the exterior. The other end of the channel 232 leads to the bore 233*b*. A flexible membrane 202 is fixed to the free end of the trumpet-like element 236, fixing being effected with the aid of return of the membrane of flexible material, which then positions itself under the edge of the free end of the trumpet-like element 236.

The inner face of the membrane 202 is provided with a conical pin 222 having the same axis as the channel 232 and having dimensions such that it can cooperate in a sealed manner with the truncated orifice 234. In the embodiment shown in Figures 7 and 8, a series of holes 223 pierced with the aid of a needle are disposed in a circle, the center of which is disposed on the axis of the channel 232.

The operation of the closure device is as follows. In the rest position, the membrane 202 rests on the outer face 236*a* of the element 236 which forms the seat of the membrane. The pin 222 closes the orifice 234 in a sealed manner and the openings 223 are closed by virtue of the elasticity of the membrane 202.

When the user wishes to dispense the product contained in the container 201, he presses the button 233*c*, resulting in depression of the movable part 233 and consequently depression of the valve stem 212. The pressurized product contained in the container 201 emerges from the valve stem 212 and passes into the channel 232. It presses on the pin 222 which clears the orifice 234 by virtue of the deformation of the membrane of flexible material 202. Under the pressure of the product, the deformation of the membrane 202 continues and a space E is formed between the membrane and the outer face 236*a* of the element 236. Finally, the holes 223 open by means of distension of the membrane. The product is then dispensed via the holes 223.

When the user ceases to press the button 233*c*, the product ceases to exert pressure on the membrane 202, which returns by means of elasticity to the rest position.

Figure 8:
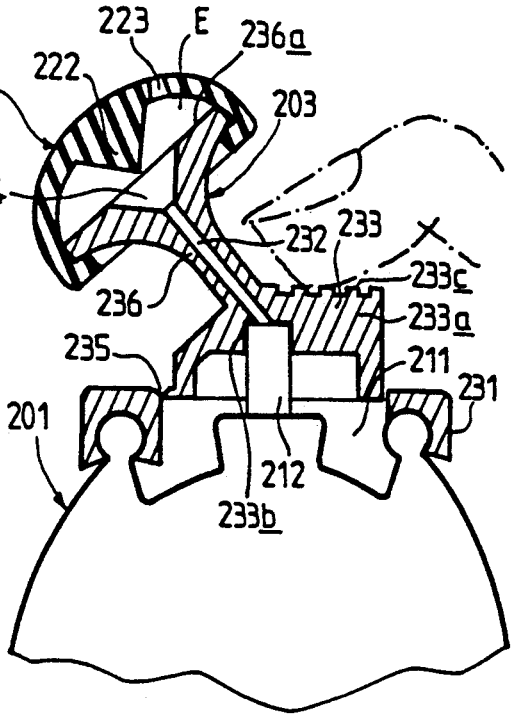
Figure 9:
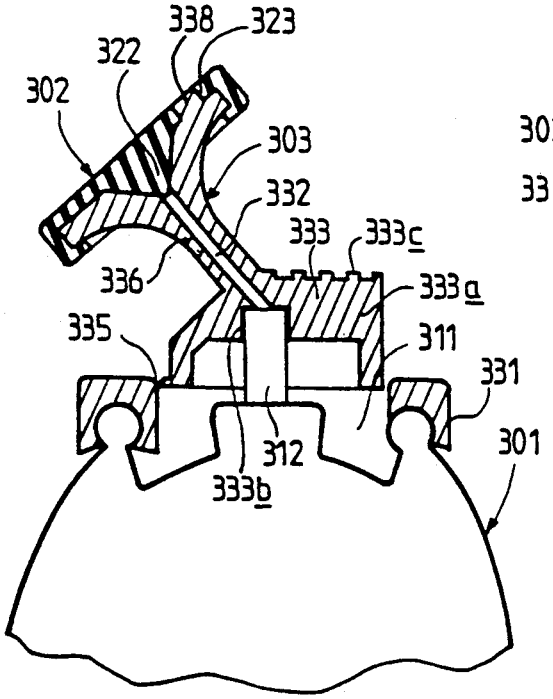
FIGS. 9 and 10 are longitudinal sections of a fourth embodiment of a device according to the invention at various stages of the opening process.
Figure 10:
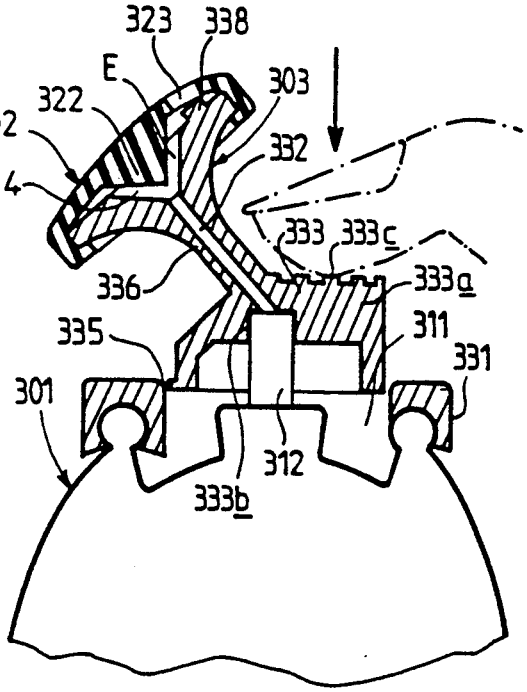

In the embodiment shown in FIGS. 9 and 10, the container 301 is identical to the container 201 shown in FIGS. 7 and 8. In the following description, the elements identical to or having the same function as the elements appearing in FIGS. 7 and 8 will be designated by the same reference numerals increased by 100.

The distributor head 303 is identical to the distributor head 203, except that the outer face of the trumpet-like element 336 is provided with a cylindrical projection 338. The membrane 302 is also identical to the membrane 202, except that instead of the holes 223 it has an opening 323 having a diameter such that the projection 338 can penetrate therein in sealed contact therewith.

The operation of the closure device is analogous to that described for the embodiment shown in FIGS. 7 and 8, except that the deformation of the membrane 302 results in release of the projection 338 from the opening 323 and that the product is dispensed via the opening 323 freed in this manner.

I claim:

1. A container for a product to be dispensed, said container having a dispensing orifice, a flexible membrane positioned so as to close said orifice, said membrane having a portion fixed to the container and being at least partly resiliently deformable to move away from said orifice under the influence of the product being dispensed and to move back to a rest position closing said orifice upon termination of the dispensing of the product, said membrane having an interior face opposing said orifice, said face including a pin member insertable into said orifice when said membrane is in said rest position, said membrane further including an opening for the passage of the product to the outside during dispensing, said container being pressurized and including a distributor head, said distributor head including an outlet channel which leads to said orifice; said outlet channel including a longitudinal axis, said membrane being symmetrical with respect to said axis of said outlet channel, said pin member being located on said interior face at a point intersected by extension of said axis of said outlet channel, said opening in said membrane for the passage of the product being located at a position spaced from said point of intersection of said axis with said membrane, said orifice being formed in a component made of rigid material and which serves as a seat for said flexible membrane, said membrane covering said component in its entirety, said component having a periphery and said membrane being fixed to said periphery of said component, said opening having edges which cooperate with the rigid surface of an element projecting from a portion of said component.

2. A container as claimed in claim 1, wherein said container includes a wall which is deformable.

3. A container as claimed in claim 1, wherein said opening is a slot formed through said membrane.

* * * * *